US005634251A

United States Patent [19]

Kraft

[11] Patent Number: 5,634,251

[45] Date of Patent: Jun. 3, 1997

[54] HEMMING APPARATUS AND METHOD FOR CREATING A HEM

[76] Inventor: Joseph D. Kraft, N8 W29947 Woodcrest Ct., Waukesha, Wis. 53188

[21] Appl. No.: 440,996

[22] Filed: May 15, 1995

[51] Int. Cl.[6] ..... B21D 37/00

[52] U.S. Cl. ..... 29/243.5; 29/890

[58] Field of Search ..... 29/565, DIG. 3, 29/890, 463, 509, 511, 510, 513, 243.5, 243.517, 283.5; 72/402, 411

[56] References Cited

U.S. PATENT DOCUMENTS

| | | | |
|---|---|---|---|
| 369,014 | 8/1887 | Kingsley . | |
| 4,485,660 | 12/1984 | Takeuchi et al. . | |
| 4,887,451 | 12/1989 | Hoff et al. | 72/402 |
| 4,918,797 | 4/1990 | Watkins et al. | 29/243.5 |
| 5,036,585 | 8/1991 | Schweinfurth . | |
| 5,119,551 | 6/1992 | Abbott | 29/890 |
| 5,150,508 | 9/1992 | St. Denis . | |
| 5,309,622 | 5/1994 | Pirchl | 29/243.5 |

FOREIGN PATENT DOCUMENTS

| | | |
|---|---|---|
| 253484 | 9/1925 | Canada . |
| 701558 | 1/1965 | Canada . |

*Primary Examiner*—Robert C. Watson
*Attorney, Agent, or Firm*—Foley & Lardner

[57] ABSTRACT

An apparatus for forming a crimped hem between two flanged components supported in a nest. The apparatus including a translational drive assembly configured to translate the nest and a wiper assembly along a longitudinal axis such that the wiper assembly is simultaneously directed transverse to the longitudinal axis. In this manner, the wiper asembly engages and bends the flange of one component over the flange of a second component forming a hem.

11 Claims, 5 Drawing Sheets

HEMMING APPARATUS AND METHOD FOR CREATING A HEM

BACKGROUND OF THE INVENTION

This invention relates generally to an improved apparatus for the hemming of two ductile flanged components. More specifically, this invention relates to the hemming of a catalytic converter and a heat shield.

In general, hemming may be utilized to join two components together, by forcing an angled flange of a first component over a flange of a second component. A crimped hem is formed by subsequently applying a pressure between the first bent flange and the second flange.

An apparatus and method to create a hem between a first component having a 90 degree flange and a second component having a straight flange is disclosed in U.S. Pat. No. 5,150,508 to St. Denis, issued Sep. 29, 1992. The apparatus uses a set of pre-hem dies for a pre-hemming operation to bend the 90 degree first component flange 45 degrees. A second set of final hem dies is utilized to complete the bending of the first component flange. This machine requires the use of three separate drive systems; a first drive system for the vertical movement of the components to be hemmed, a second drive system for the actuation of the pre-hem die set and a third drive system for the actuation of the final-hem die set. Additionally, this invention requires the components to be cycled up and down twice, first for engagement with the pre-hem die set and second with engagement with the final die set.

The two step apparatus and method for hemming two components requires the use of two presses and/or die sets, and the use of more than one drive system and cycle.

Canadian Patent No. 253,484 discloses a one-step hemming machine for car doors which combines the pre-hemming and final hemming operations into a single machine. In this machine, a die block is moved in a single stroke through a linkage mechanism. Similarly, Canadian Patent No. 701,558 discloses a one-step hemming machine for automobile doors in which a die block is rotatably moved in a single stroke through a linkage mechanism. In both of these machines, the components and supporting bed remain stationary during the hemming operation. However, it has been noted that these machines involve the requirement to accurately index the position of the die block. Additionally, the use of a single die block has a tendency to roll the flange edge of one of the components altering the dimensional integrity of the final assembly.

Consequently, it would be desirable to have a hemming apparatus and method that could create a crimped hem utilizing a single drive system that could be accomplished in one cycle while maintaining dimensional integrity of the final assembly.

SUMMARY OF THE INVENTION

The present invention features an apparatus and method for creating a crimped hem between two flanged components such as a catalytic converter and an associated heat shield.

An embodiment of the apparatus for hemming two components includes a nest having a support member configured to support a first component having a first flange and a second component having an angled flange. The apparatus also includes a wiper assembly. The apparatus further includes a translational drive assembly configured to translate the nest and wiper assembly along a longitudinal axis and simultaneously direct the wiper assembly transverse to the longitudinal axis. As a result, the wiper assembly engages and bends the angled flange of the second component over the first flange of the first component forming a hem.

Another embodiment of the apparatus for forming a crimped hem includes a nest having a nest hem support and a nest beveled surface. A first wiper and a second wiper each have a wiper hem edge and a wiper crimp surface. The first wiper is attached to a first side slide and the second wiper is attached to a second side slide. The first side slide and second side slide each have a side slide beveled edge configured to engage the nest beveled edge as the wipers are directed transverse to the longitudinal axis.

A further embodiment of the apparatus for forming a crimped hem includes a front wiper attached to a front support, and a rear wiper attached to a rear support. The rear support is attached to a drive system and coupled to a slide carrier with a spring element. The nest includes a front and rear beveled surface. The front support includes a front beveled surface configured to engage the front nest beveled surface to raise the nest toward a front wiper crimp surface. The rear support includes a rear beveled surface configured to engage the rear nest beveled surface to raise the nest toward a rear wiper crimp surface.

The present invention further provides a method for forming a crimped hem by placing a first component having a straight flange and a second component having an angled flange in a nest. The nest and components along with a first wiper having a wiper edge and a wiper crimp edge, are translated along a longitudinal axis for a set distance. The first wiper is simultaneously directed along and transverse to the longitudinal axis. In this manner, the wiper edge engages and bends the second component flange forming a hem.

Another method for forming a crimped hem includes first placing a first component having a first flange and a second component having a second flange in a nest. The nest and components along with a wiper assembly having a wiper edge and a wiper crimp edge, are translated along a longitudinal axis for a set distance. The wiper assembly is simultaneously directed along and transverse to the longitudinal axis. In this manner, the wiper edge engages and bends the second component flange forming a hem.

DETAILED DESCRIPTION OF THE PREFERRED EMBODIMENT

Figure 2:
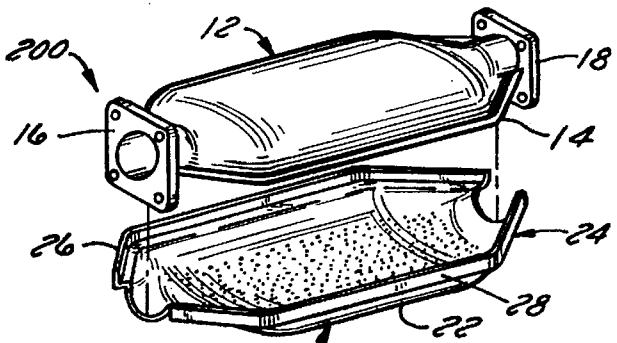
FIG. 2 is a perspective view of the catalytic converter and heat shield.
Figure 1A:
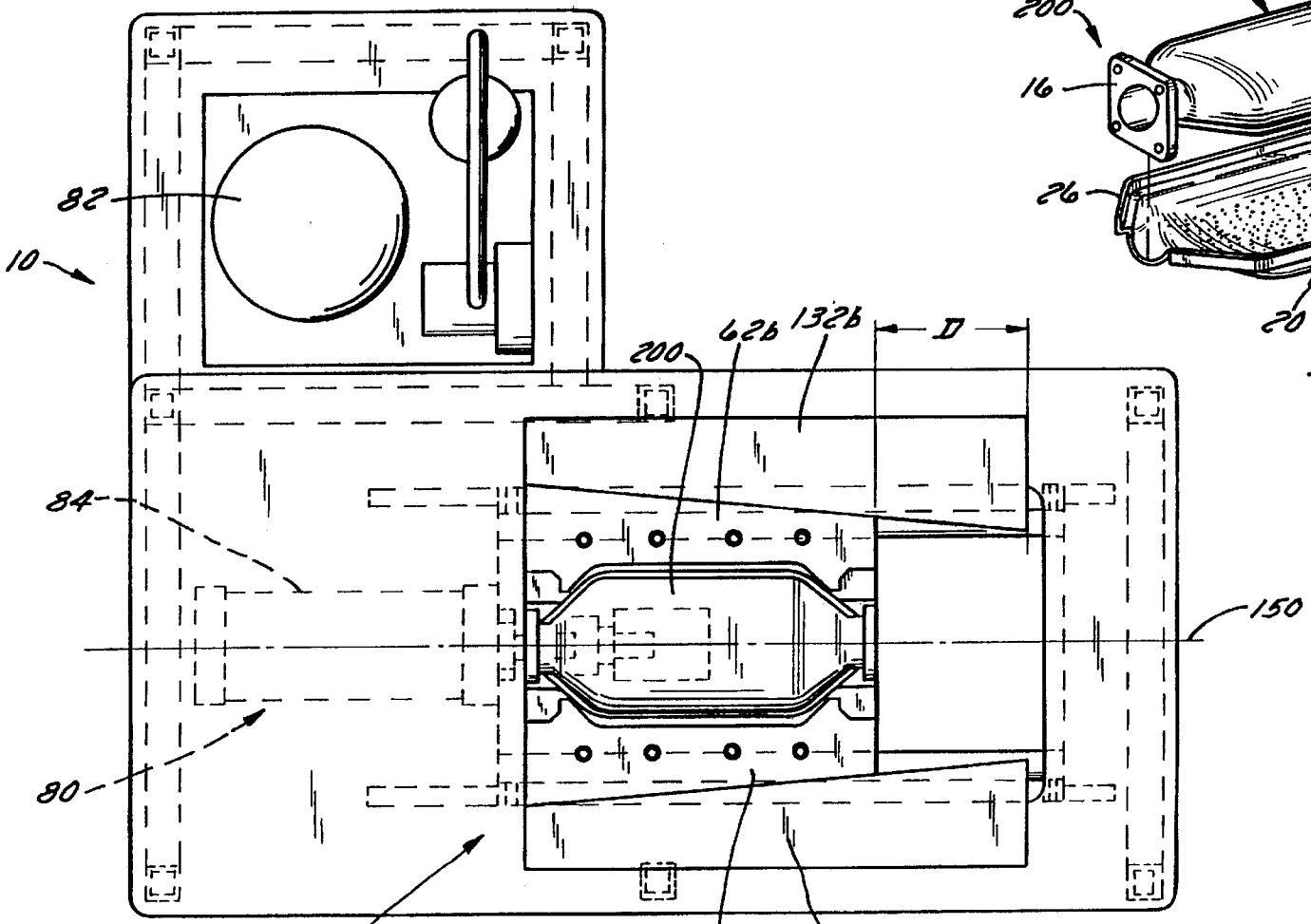
FIG. 1*a* is a schematic plan view of the top side of the a hemming apparatus in the open position.
Figure 1B:
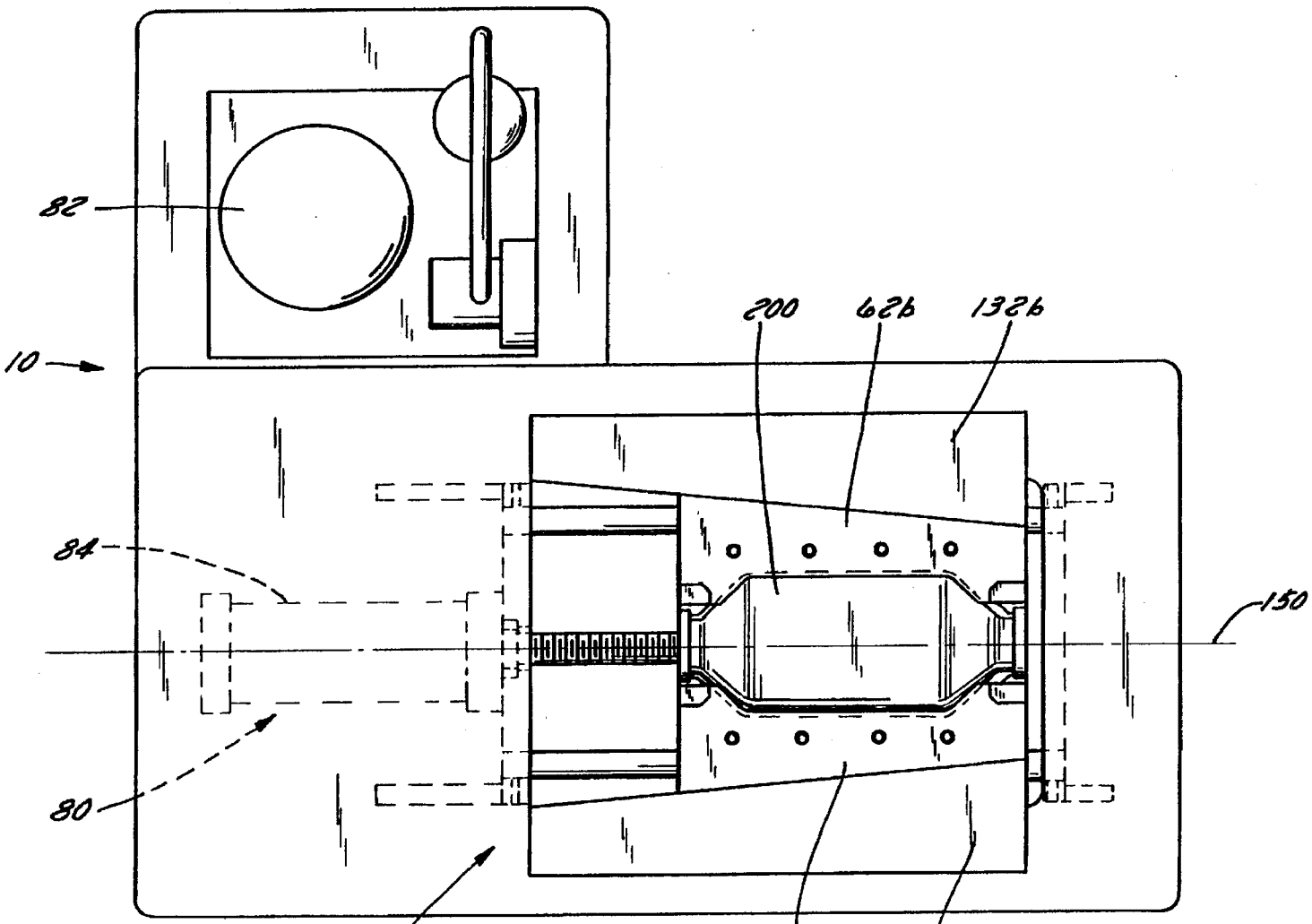
FIG. 1*b* is a schematic plan view of the top side of the apparatus in the engaged position.

Referring to FIGS. 1–5, a hemming apparatus 10 and the operation thereof will first be discussed generally. Apparatus 10 creates a crimped hem between a catalytic converter 12 and a heat shield 20 (FIG. 2). The apparatus includes a nest 30, a wiper assembly 62 having a pair of wipers 62*a*, 62*b*, and a translational drive assembly 78. Translational drive assembly 78 includes a drive system 80, a sled 94, a slide carrier block 100, a first and second side slide 112*a*, 112*b*, and a first and second angled guide 132*a*, 132*b*.

Figure 4:
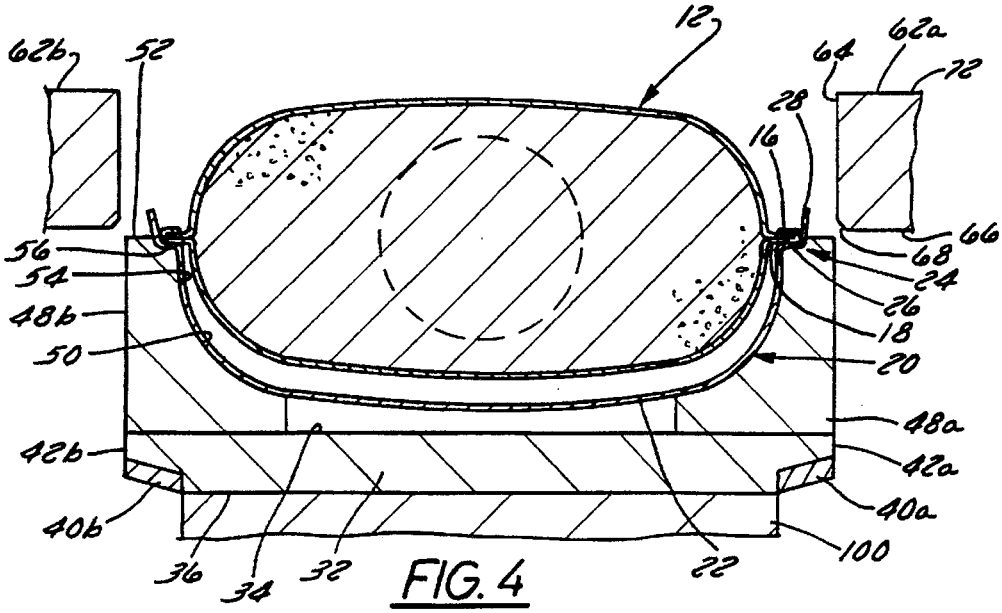
FIG. 4 is a cross sectional view of the catalytic converter and heat shield assembly located within the nest for the apparatus illustrated in FIG. 3.
Figure 5A:
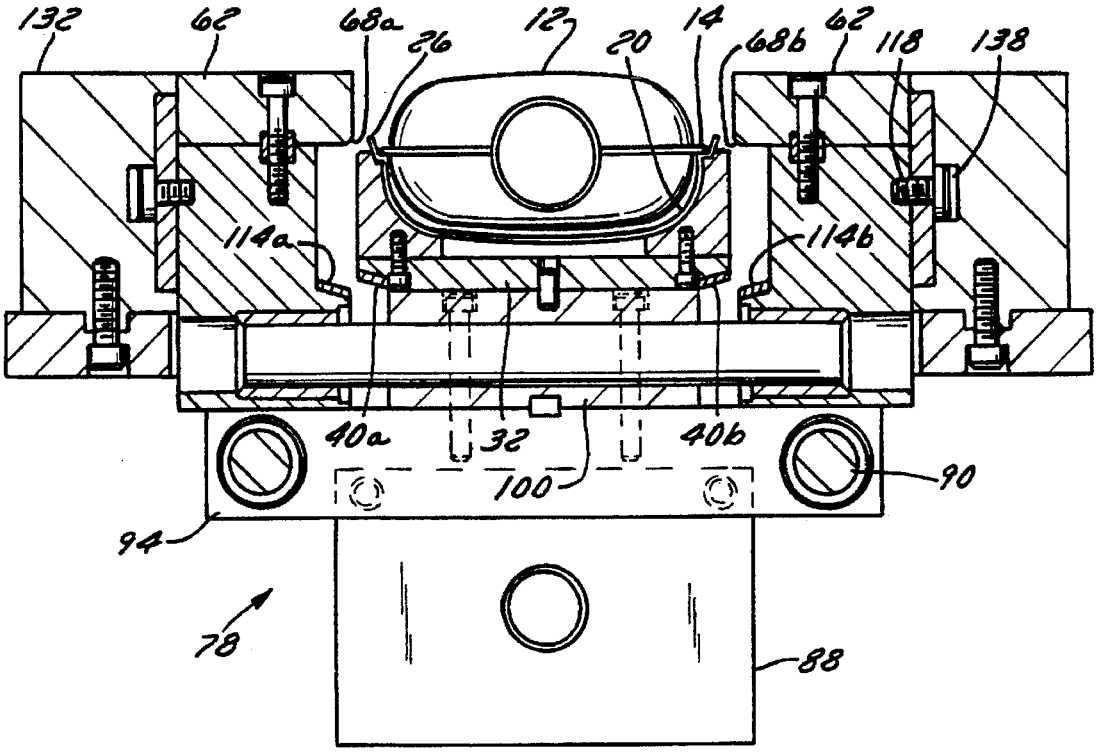
FIG. 5*a* is a cross sectional view of the apparatus illustrated in FIG. 1*a* in the open position with the catalytic converter and heat shield assembly supported by the nest prior to hemming.
Figure 5B:
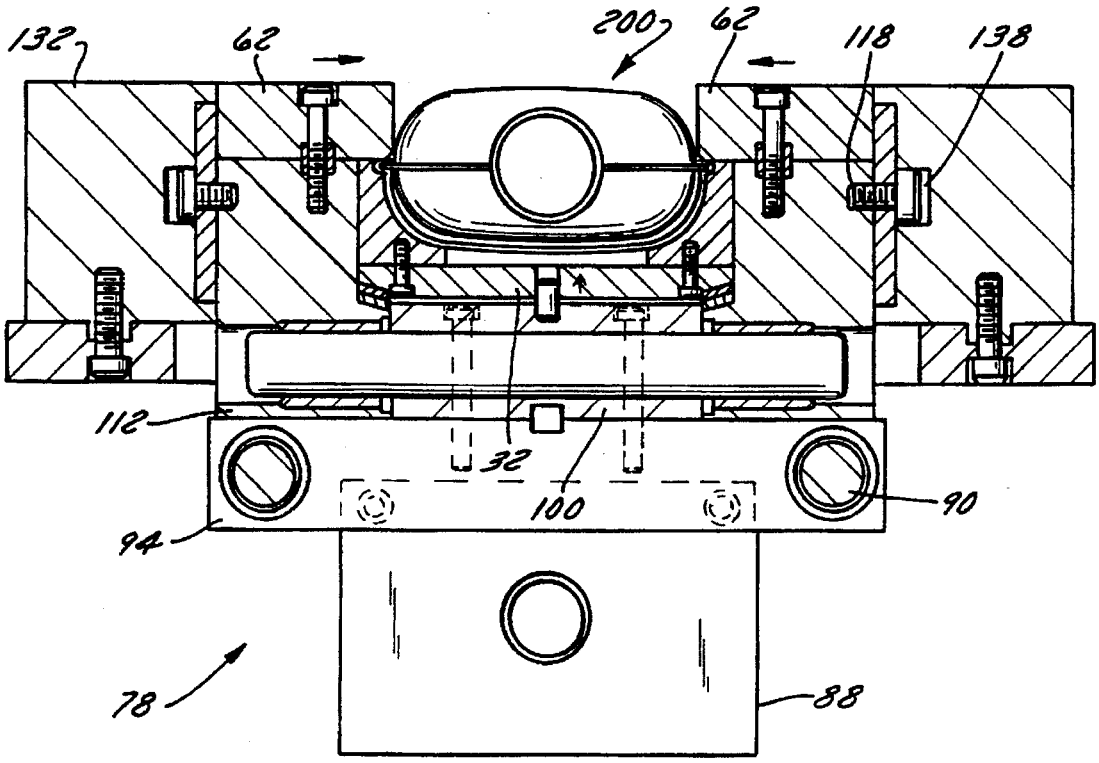
FIG. 5*b* is a cross sectional view of the apparatus illustrated in FIG. 1*b* in the engaged position with the catalytic converter and heat shield assembly having a crimped hem.

Referring to FIGS. 2 and 4 catalytic converter 12 includes a converter flange 14 having a converter flange first side 16 and a converter flange second side 18. Heat shield 20 includes a heat shield bottom surface 22 and a flange 24. Flange 24 includes a first portion 26 and a second portion 28 extending upward therefrom at about a 90 degree angle.

A crimped hem is formed between catalytic converter 12 and heat shield 20 by first locating catalytic converter 12 and heat shield 20 within nest 30. Utilizing a single longitudinal stroke translational drive assembly 78 translates nest 30, catalytic converter 12 and heat shield 20 a set distance D along a longitudinal axis 150. Simultaneously first and second wipers 62*a*, 62*b* are guided transverse to longitudinal axis 150 such that heat shield flange 24 is bent over converter flange 14 forming a hem between catalytic converter 12 and heat shield 20. Toward the end of the longitudinal stroke nest 30 is raised vertically toward wipers 62*a*, 62*b* compressing the hem and forming a crimped hem.

Referring to FIGS. 1–6, the preferred embodiment of apparatus 10 will be described in greater detail. Nest assembly 30 includes a plate 32, a first side nest 48*a* and a second side nest 48*b*. First and second side nests 48*a*, 48*b* are removably attached to plate 32 by at least one nest side bolt 60. However, first and second side nests 48*a*, 48*b* may be integrally formed with plate 32 or permanently attached to plate 32.

Plate 32 is defined by a plate top 34, a plate bottom 36, a first plate side 42*a*, a second plate side 42*b*, a plate front, and a plate rear. Plate 32 includes a first nest beveled surface 40*a* and a second nest beveled surface 40*b* such that plate bottom 36 has an angled transition to the first and second plate sides 42*a*, 42*b*. In the preferred embodiment, plate 32 also includes a pair of locator through holes 38 extending from plate top 34 to plate bottom 36.

First and second side nests 48*a*, 48*b* are each provided with a nest side inner wall 50 configured to match the form of heat shield bottom surface 22. Side nests 48*a*, 48*b* further include a nest side hem support 52, a nest side hem wall 54, and a nest side hem top surface 56. Nest side hem support 52 is configured to support the first portion 26 of heat shield flange 24. In the preferred embodiment, nest side hem support 52 is substantially parallel to plate top 34. Nest side hem wall 54 is substantially normal to nest side hem support 52 and is the transition between nest side hem support 52 and nest side hem top surface 56. The distance between nest side hem support 52 and nest side hem top surface 56 is less than or equivalent to the thickness of a final crimped hem or approximately twice the thickness of heat shield flange 24 plus the thickness of converter flange 14. Nest side hem top surface 56 is substantially parallel to plate top 34.

In the preferred embodiment, wiper assembly include first wiper 62*a*, and second wiper 62*b*. However, where a hemming operation is limited to a single side of a pair of components, wiper assembly 62 may include a single wiper 62*a*. In the preferred embodiment, first wiper 62*a* and second wiper 62*b* each include a wiper inner surface 64 substantially normal to converter flange 14 and substantially parallel to second portion 28 of heat shield flange 24. Wipers 62*a*, 62*b* further includes a wiper bottom 66 and a wiper top 72 substantially normal to wiper inner surface 64.

Wipers 62*a*, 62*b* further include a wiper hem edge 68 defined by the transition between wiper inner surface 64 and wiper bottom 66. Additionally, wiper bottom 66 includes a wiper crimp surface 70 contiguous to wiper hem edge 68.

Figure 6:
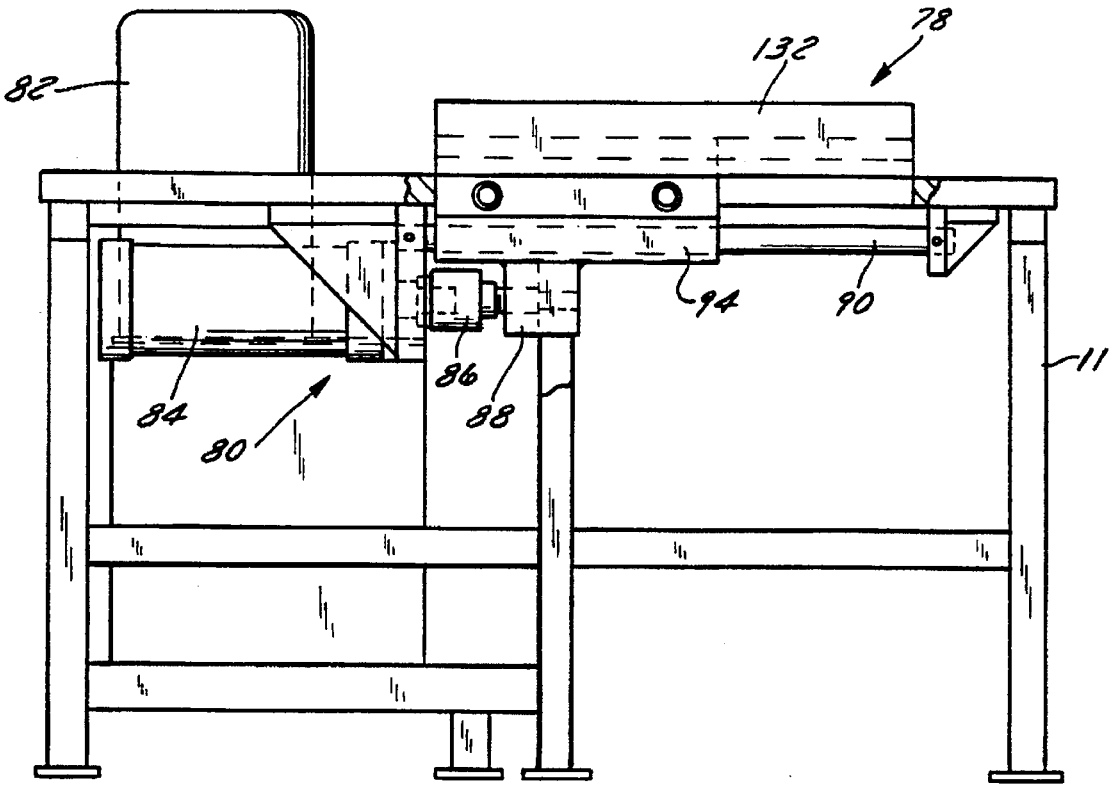
FIG. 6 is a schematic side view of the apparatus.

Referring to FIG. 6, translational drive assembly 78 includes drive system 80 having a power unit 82, an actuator 84 and a coupling nut 86. In the preferred embodiment, power unit 82 is a hydraulic pump and actuator 84 is a hydraulic cylinder having a piston and rod. Coupling nut 86 is adjustably attached to the rod. Coupling nut 86 includes a shaft that is attached to an attachment block 88. However, power unit 82 may be a compressor or an electric source. Similarly, actuator 84 may be a pneumatic cylinder or a rotary screw mechanism.

Figure 3:
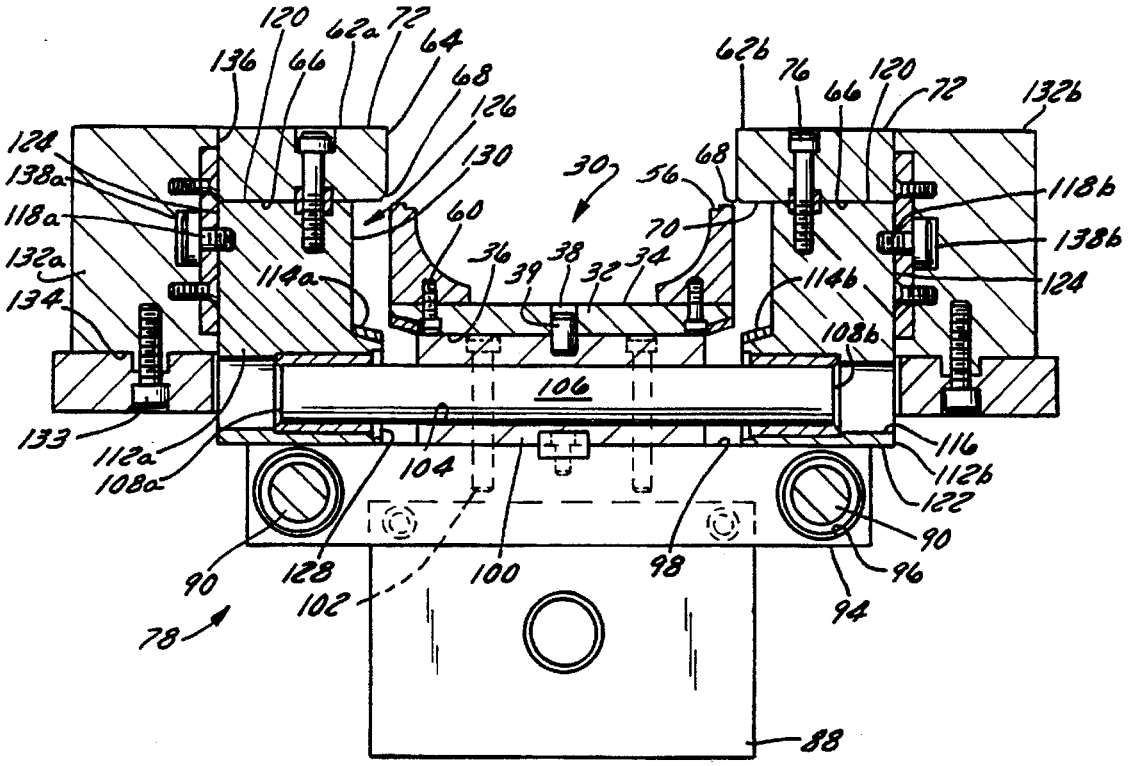
FIG. 3 is a cross sectional view of the apparatus illustrated in FIG. 1 in the open position.

Referring to FIG. 3, translational drive assembly 78 includes sled 94 having a pair of sled through holes 96 and a sled top 98. Sled 94 is slideably supported by a pair of rods 90 having an axial direction parallel to longitudinal axis 150. Rods 90 are attached to a frame 11 (FIG. 6).

Translational drive assembly 78 further includes slide carrier block 100 attached to sled 94 by slide carrier block bolts 102. Slide carrier block 100 includes a pair of slide carrier block through holes 104 substantially transverse to the axial direction of rods 90. A pair of pins 106 having a first pair of ends 108*a* and a second pair of ends 108*b* are engaged within slide carrier block through holes 104 such that first pair of ends 108*a* and second pair of ends 108*b* extend beyond carrier slide block 100. Slide carrier block 100 further includes locating pins 39 in locator through holes 38 to floatably locate nest 30.

Translational drive assembly 78 further includes first side slide 112*a* and a second side slide 112*b*. Each side slide 112*a*, 112*b* includes a pair of side slide recesses 116 which receive pins 106 permitting axial translation of side slides 112*a*, 112*b* along pins 106. Side slide recesses 116 may also contain an axial bearing permitting axial translation of side slides 112*a*, 112*b* along pins 106. Side slides 112*a*, 112*b* further include a side slide bottom 122, a side slide outer surface 124 substantially normal to side slide bottom 122, and a side slide top surface 120 substantially parallel to side slide bottom 122. Side slides 112*a*, 112*b* further includes a side slide inner surface 126 having a first region 128 with side slide through recesses 116, and a second region 130 substantially parallel to the first region 128. Side slide inner surface 126 further includes a side slide beveled edge 114 connecting first region 128 and second region 130.

Side slide outer surface 124 includes a side slide tab 118. In the preferred embodiment, side slide tab 118 has a T shape, however other configurations are also possible. Side slides 112*a*, 112*b* are slideably located on sled 94 such that side slide bottom 122 is proximate with sled top 98. Side slides 112*a*, 112*b* include a plurality of side slide threaded apertures to removeably attach Wipers 62*a*, 62*b* with a plurality of wiper bolts 76.

Translational drive assembly 78 further includes first angled guide 132*a* and second angled guide 132*b*. Angled guides 132*a*, 132*b* are attached to frame 11 with angled guide bolts 133. Angled guides 132*a*, 132*b* include an angled guide bottom surface 134, and an angled guide inner surface 136 having a angled guide T gib 138 slideably receiving side slide tab 118. Angled guide inner surface 136 is substantially normal to an angled guide bottom surface 134. In the preferred embodiment, angled guide inner surface 136 is positioned at an angle to longitudinal axis 150 such that the distance between angle guides 132*a* and 132*b* decreases along the longitudinal axis 150.

The method to create a crimped hem utilizing apparatus 10 will now be described in greater detail. Catalytic converter 12 is first manually placed within heat shield 20 forming a converter-shield assembly 200 such that converter flange 14 is substantially flush against the first portion 26 of heat shield flange 24. With apparatus 10 in the open position (See FIGS. 1*a*, and 5*a*), converter-shield assembly 200 is located within nest 30 such that the first portion 26 of heat shield flange 24 is supported by nest side hem supports 52. Converter-shield assembly 200 is located within nest 30 such that the second portion 28 of heat shield flange 24 is contained between nest side hem walls 54.

Actuator 84 is activated such that attachment block 88 is translated along longitudinal axis 150. Sled 94 which is fastened to attachment block 88 is translated along longitudinal axis 150 along pair of rods 90. In this manner, nest 30 which is floatably attached to slide carrier block 100 which in turn is attached to sled 94 is translated along longitudinal axis 150.

Side slides 112*a*, 112*b* attached to slide carrier block 100 by pins 106 are also translated along longitudinal axis 150. Side slides tabs 118*a*, 118*b* are slideably engaged in angled guide T gibs 138*a*, 138*b*. As a result, side slides 112*a*, 112*b* are simultaneously guided along angled guides 132*a*, 132*b* in a direction transverse to longitudinal axis 150 as sled 94 and slide carrier block 100 are translated along longitudinal axis 150.

Wipers 62*a*, 62*b* which are attached to side slides are also translated along longitudinal axis 150 and simultaneously guided transverse to longitudinal axis 150 by angled guides 132*a*, 132*b*.

As wipers 62*a*, 62*b* are guided transverse to longitudinal axis 150, wiper hem edges 68 engage and bend second portion 28 of heat shield flange 24 over converter flange 14. As wiper hem edges 68*a*, 68*b* engage second portion 28 of heat shield flange 24, the force applied on both sides of the converter-shield assembly 200 will have a tendency to center the converter-shield assembly 200 between wipers 62*a*, 62*b*. The floatable attachment of nest 30 to slide carrier block 100 permits the appropriate centering of the converter-shield assembly 200 to ensure wipers 62*a*, 62*b* will not over travel and damage catalytic converter 12 or heat shield 20.

As actuator 84 approaches the end of the stroke side slide beveled edges 114*a*, 114*b* of side slides 112*a*, 112*b* engage beveled edges 40*a*, 40*b* of nest 30 resulting in a vertical displacement of nest 30 with respect to wiper edge 68. In this manner, heat shield flange 24 is compressed against catalytic converter flange 14 resulting in a crimped hem (See FIG. 1*b*). The extent of translation of attachment block 88 may be adjusted by coupling nut 86. Adjustment of coupling nut 86 permits the user to adjust the length of longitudinal travel of nest 30 thereby adjusting the extent of transverse travel of wipers 62 and the extent of vertical travel of nest 30 with respect to the wiper crimp surfaces 70.

At the end of the stroke, actuator 84 is reversed and sled 94, slide carrier block 100 and nest 30 are translated back to the open position. At the beginning of the return stroke nest beveled surfaces 40*a*, 40*b* of nest 30 disengages from side slide beveled edges 114*a*, 114*b* of side slides 112*a*, 112*b*. As sled 94 is translated back to the open position, side slides 112*a*, 112*b* and wipers 62*a*, 62*b* are simultaneously guided transverse to the longitudinal axis 150 along angled guides 132*a*, 132*b* such that slides 112*a*, 112*b* and wipers 62*a*, 62*b* are directed away from nest 30. Sled 94 is translated back to the open position at which point the completed converter-shield assembly 200 having a crimped hem is removed.

Figure 7:
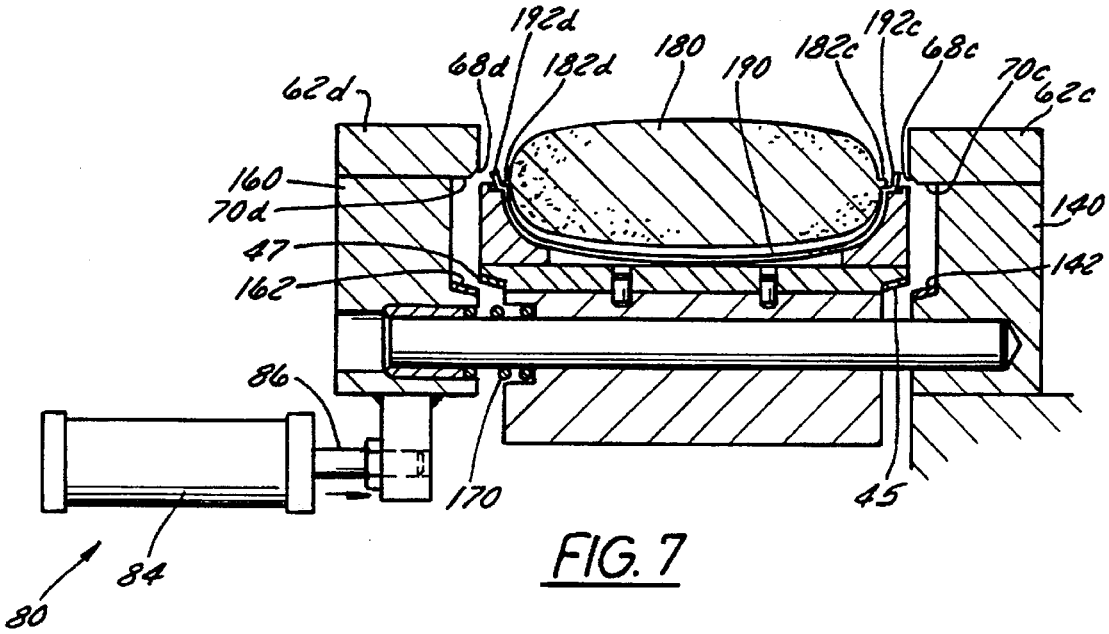
FIG. 7 is a cross sectional view of the apparatus illustrated in FIG. 1 with a front and rear wiper for providing a crimped hem circumscribing a first and second component.

In an alternative embodiment, apparatus 10 is configured to form a crimped hem substantially circumscribing a first component 180 having a first component flange 182 and a second component 190 having a second component flange 192 (See FIG. 7). First component flange 182 includes a pair of side flange portions (not shown), a front flange portion 182c, and a rear flange portion 182*d*. Second component flange 192 includes a pair of second component side flange portions (not shown), a second component front flange portion 192*c*, and a second component rear flange portion 192*d*.

In this alternative embodiment, apparatus 10 includes a front wiper 62*c* removeably attached to a front support 140. Apparatus 10 further includes a rear wiper 62*d* removeably attached to a rear support 160. Front wiper 62*c* includes a front wiper hem edge 68*c* and a front wiper crimp surface 70*c*. Rear wiper 62*d* includes a rear wiper hem edge 68*d* and a rear wiper crimp surface 70*d*.

Rear support 160 is attached directly to drive system 80. Rear support 160 is further springedly attached to slide carrier block 100 by a spring 170.

In contrast with the preferred embodiment, sled 94 is not attached to attachment block 88 but rather is free to move along rods 90. In this alternative embodiment, front support 140 includes a front support beveled surface 142, and rear support 160 includes a rear support beveled surface 162. Nest 30 includes a front nest beveled surface 45, and a rear nest beveled surface 47.

In this alternative embodiment, spring element 170 may be a coiled spring in which the spring force is sufficient to maintain a separation between rear support 160 and nest 30 as actuator 86 drives nest 30 along the longitudinal axis 150. As nest 30 engages front wiper 62*c*, front wiper hem edge 68*c* engages and bends second component front flange 192*c*. As nest 30 engages front support 140 spring force is overcome and rear wiper 62*d* is driven forward such that rear wiper hem edge 68*d* engages and bends rear flange 192*c* thereby forming a hem.

As the nest 30 approaches the end of the translation, side slide beveled edges 114*a*, 114*b* of side slides 112*a*, 112*b* engage nest beveled surfaces 40*a*, 40*b* of nest 30, a beveled edge 142 of front support 140 engages a nest beveled surface 45 of nest 30, and a beveled edge 162 of rear support 160 engages a nest beveled surface 47 of nest 30 resulting in a vertical displacement of nest 30 with respect to wiper edges 68*a*, 68*b*, 68*c* and 68*d*. In this manner, first component flange 192 is compressed against second component flange 182 resulting in a crimped hem circumscribing the first and second components 180, 190. Stated in other words, this alternative embodiment may be utilized to create a crimped hem that surrounds the first and second components 180, 190 either substantially or completely.

In another alternative embodiment, apparatus 10 is configured to form a crimped hem between a first component having a first straight flange and a second component having a second straight flange extending beyond the first straight flange. In this embodiment, wipers 62 include an angled lead-in that engages and bends a portion of the second flange extending beyond the first flange from a position parallel to the first flange to a position normal to the first flange. A crimped hem is then subsequently formed as described above.

The use of an angled lead-in on wipers 62 permit the formation of a hem where the first component has an angled flange ranging from 0 degrees relative to the second component flange to 90 degrees relative to the second component flange.

Although the invention has been described in conjunction with specific embodiments thereof, it is evident that alternatives, modifications and variations will be apparent to those skilled in the art. For example, as noted above apparatus 10 can be configured to form a crimped hem on only one side of the components by utilizing a single wiper 62. Also, wiper assembly 62 may include a roller or a plurality of rollers. Further, the rollers may be rotated relative to the first and second components where the rollers also move radial to the components to form the hem. Additionally, wipers 62 and side slide 112 can be integrally formed. Similarly, plate 32 can be integrally formed with nest side 48 to form nest 30. Other components can be similarly integrated. Drive system 80 can include a control mechanism to modulate the rate in which the hem is formed. It is intended that the claims embrace these and other alternatives, modifications and variations which fall within the spirit and scope of the appended claims.

I claim:

1. An apparatus for hemming a first component having a first flange with a second ductile component having a second flange comprising:

a nest having a support member configured to support a first component having a straight flange and a second component having an angled flange;

a wiper assembly; and a translational drive assembly configured to translate the nest and wiper assembly along a longitudinal axis and simultaneously direct the wiper assembly transverse to the longitudinal axis to engage and bend the angled flange of the second component over the first flange of the first component to form a hem;

wherein the translational drive assembly includes a first side slide and a second side slide, wherein the nest includes a nest hem support and a nest beveled surface, and wherein the wiper assembly includes a first wiper and second wiper each having a wiper hem edge and a wiper crimp surface, the first wiper is attached to the first side slide and the second wiper is attached to the second side slide, the first side slide and second side slide each having a side slide beveled edge configured to engage the nest beveled edge as the wipers are directed transverse to the longitudinal axis.

2. The apparatus of claim 1 wherein the nest is floatably and removeably attached to the translational drive assembly.

3. The apparatus of claim 1 wherein the translational drive assembly includes a drive system comprising:

a power unit;

an actuator;

an attachment block; and an adjustable coupling configured to adjust the length of the longitudinal travel of the actuator.

4. The apparatus of claim 1 wherein the wipers are removeably attached to the translational drive assembly.

5. The apparatus of claim 1 wherein the translational drive assembly comprises:

a frame configured to support a pair of rods parallel to the longitudinal axis;

a sled slideably supported by the pair of rods;

a slide carrier attached to the sled, the slide carrier having a first and second through hole transverse to the longitudinal axis;

a first angled guide and a second angled guide configured to direct the first and second side slides tangential to the longitudinal axis; and wherein the first side slide and the second side slide have a pair of slide carrier recesses, the first side slide and second side slide slideably supported by the slide carrier and joined together with a pair of pins extending through the slide carrier through holes slideably and axially engaged in the first and second slide carrier recesses.

6. The apparatus of claim 1 wherein the first component is a catalytic converter and the second component is a heat shield.

7. The apparatus of claim 1 further including a front wiper attached to a front support, and a rear wiper attached to a rear support, the rear support attached to the drive system and coupled to the slide carrier with a spring element, the nest further including a front and rear beveled surface, the front support including a front beveled surface configured to engage the front nest beveled surface to raise the nest toward a front wiper crimp surface, the rear support including a rear beveled surface configured to engage the rear nest beveled surface to raise the nest toward a rear wiper crimp surface.

8. An apparatus for hemming a first component having a straight flange with a second component having an angled flange comprising:

a nest having a support member configured to support the first component having a straight flange and the second component having an angled flange, the nest further including a flange support surface and a beveled nest edge, the nest floatably and removeably supported by a slide carrier block;

a first wiper and a second wiper having a wiper edge and a wiper crimp surface, the first and second wipers attached to a first and second side slide slideably supported on the slide carrier block;

a first angled guide and a second angled guide having a inner guide surface at an angle relative to the longitudinal axis; and a translational drive assembly configured to translate the nest and wiper along a longitudinal axis such that the angled guides simultaneously direct the wipers transverse to the longitudinal axis whereby the wipers engage and bend an angled flange of the second component over a straight flange of the first component forming a hem;

the translational drive assembly further including a first and second side slide each having a beveled slide edge configured to engage the beveled nest edge on the nest as the wipers are directed transverse to the longitudinal axis raising the nest toward the wiper crimp surface whereby the hem is compressed between the flange support surface and the wiper crimp surface forming a crimped hem.

9. The apparatus of claim 8 wherein the first component is a catalytic converter and the second component is a heat shield.

10. The apparatus of claim 8 wherein the translational drive assembly includes a drive system comprising:

a power unit;

an actuator; and an adjustable coupling configured to adjust the length of the longitudinal travel of the actuator.

11. The apparatus of claim 10 further comprising:

a front wiper attached to a front support, and a rear wiper attached to a rear support, the rear support attached to the drive system, the rear support springedly coupled to the slide carrier block with a spring element; and wherein the nest includes a front and rear beveled surfaces, the front support including a front beveled surface configured to engage the front nest beveled surface to raise the nest toward a front wiper crimp surface, and the rear support including a rear beveled surface configured to engage the rear nest beveled surface to raise the nest toward a rear wiper crimp surface.

* * * * *